US009936855B1

(12) United States Patent
Schmidt et al.

(10) Patent No.: US 9,936,855 B1
(45) Date of Patent: Apr. 10, 2018

(54) SPATULA CLEANING ASSEMBLY

(71) Applicants: Joe Schmidt, Pleasanton, CA (US); Ray Schmidt, Pleasanton, CA (US)

(72) Inventors: Joe Schmidt, Pleasanton, CA (US); Ray Schmidt, Pleasanton, CA (US)

( * ) Notice: Subject to any disclaimer, the term of this patent is extended or adjusted under 35 U.S.C. 154(b) by 0 days.

(21) Appl. No.: 15/290,050

(22) Filed: Oct. 11, 2016

(51) Int. Cl.
*A47L 17/00* (2006.01)
*A47L 17/06* (2006.01)

(52) U.S. Cl.
CPC ..... *A47L 17/00* (2013.01); *A47L 17/06* (2013.01)

(58) Field of Classification Search
CPC ..... A47J 43/288; A47L 17/06; A47L 17/10; A47L 17/00
See application file for complete search history.

(56) References Cited

U.S. PATENT DOCUMENTS 2,719,313 A * 10/1955 Smith ..... A47L 21/04 15/118
2,776,667 A * 1/1957 Fitz ..... A45D 7/04 132/224
4,716,677 A * 1/1988 Moore ..... A01M 21/043 15/220.3
5,308,406 A 5/1994 Wallock et al.
5,652,993 A 8/1997 Kreyer
7,200,891 B1 4/2007 McCulloch et al.
8,256,808 B2 * 9/2012 Spellman ..... A47G 21/10 15/236.06
8,474,176 B2 * 7/2013 Shelton ..... A01M 3/04 132/148
D691,772 S 10/2013 Blaisdell et al.
8,607,396 B2 12/2013 Albright
8,950,033 B1 2/2015 Keeler
2005/0273957 A1 12/2005 Boltryk
2006/0123577 A1 * 6/2006 Luster ..... B05C 17/00 15/210.1

* cited by examiner

*Primary Examiner* — Randall Chin

(57) ABSTRACT

A spatula cleaning assembly for cleaning a spatula includes a scraper that may be manipulated. The scraper frictionally engages a spatula such that the scraper removes debris from the spatula. A panel is hingedly coupled to the scraper. The panel is manipulated to compress the spatula between the scraper and the panel.

1 Claim, 3 Drawing Sheets

SPATULA CLEANING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to spatula cleaning assemblies and more particularly pertains to a new spatula cleaning assembly for cleaning a spatula.

BRIEF SUMMARY OF THE INVENTION

An embodiment of the disclosure meets the needs presented above by generally comprising a scraper that may be manipulated. The scraper frictionally engages a spatula such that the scraper removes debris from the spatula. A panel is hingedly coupled to the scraper. The panel is manipulated to compress the spatula between the scraper and the panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
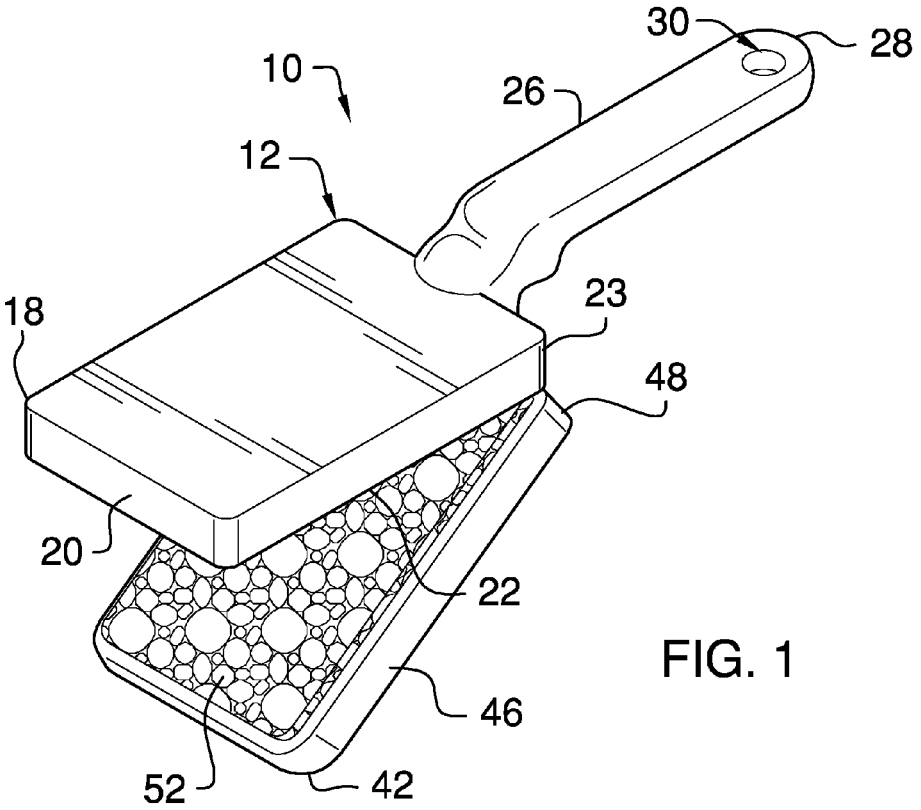
FIG. 1 is a perspective view of a spatula cleaning assembly according to an embodiment of the disclosure.
Figure 2:
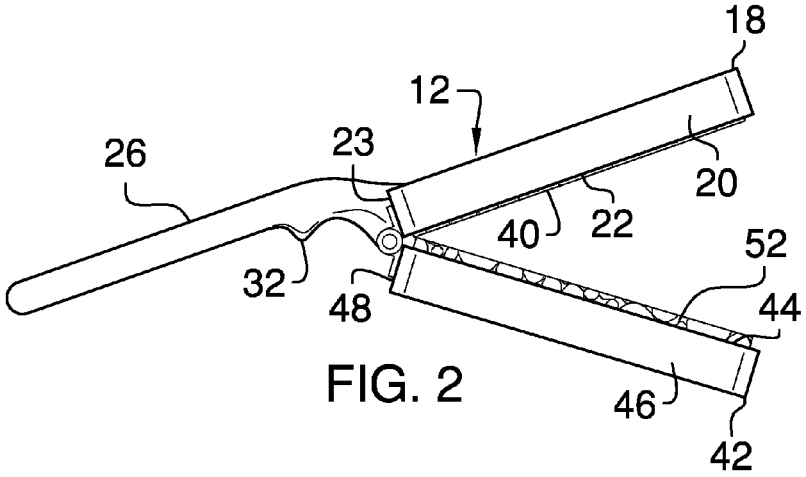
FIG. 2 is a right side view of an embodiment of the disclosure in an open position.
Figure 3:
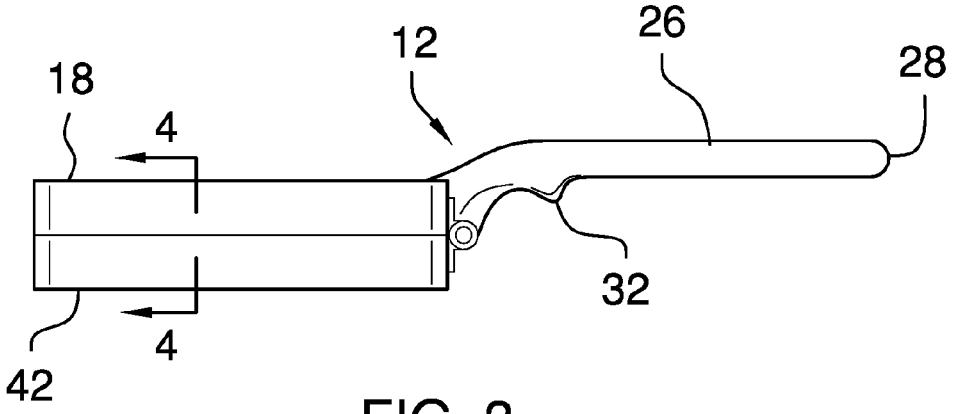
FIG. 3 is a left view of an embodiment of the disclosure in a closed position.
Figure 4:
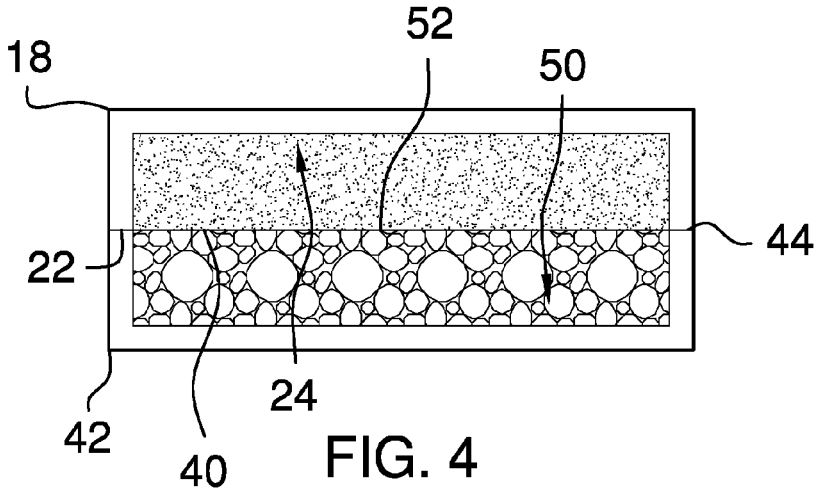
FIG. 4 is a cross sectional view taken along line 4-4 of FIG. 3 of an embodiment of the disclosure.
Figure 5:
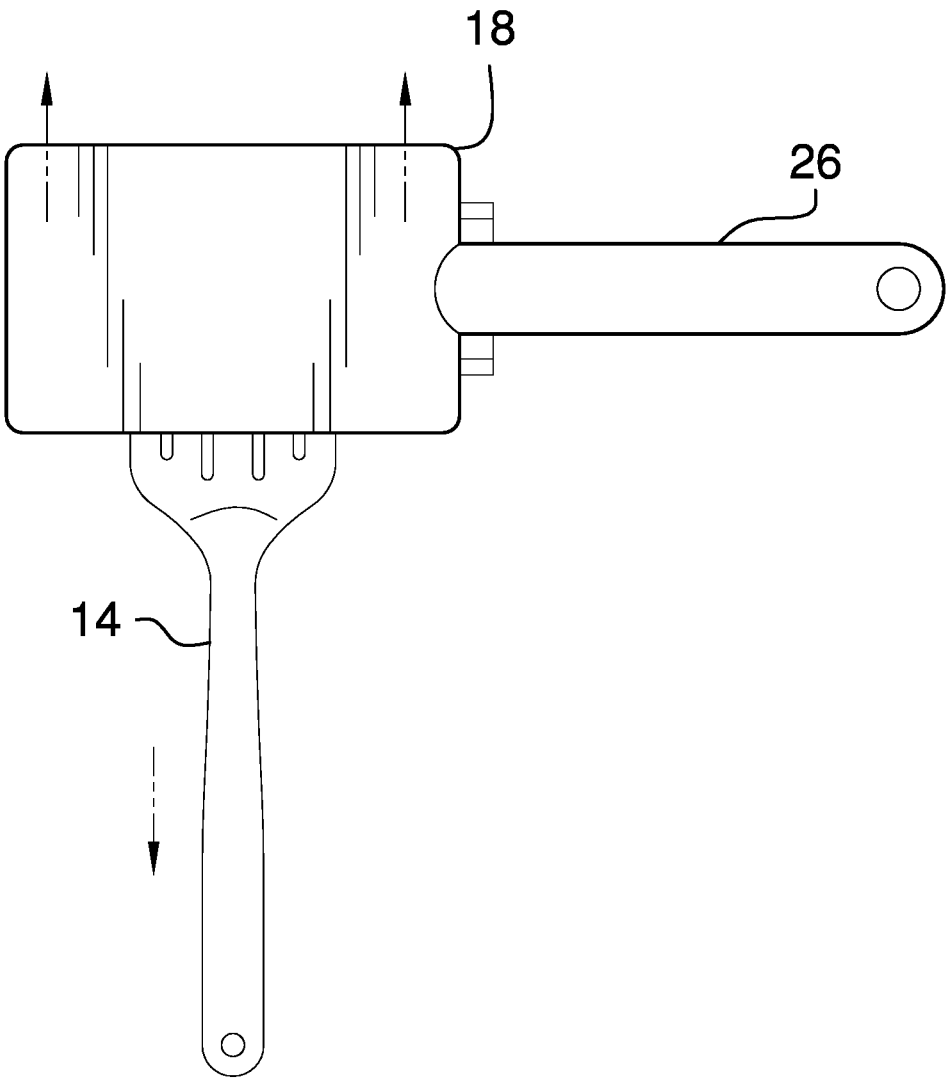
FIG. 5 is a perspective in-use view of an embodiment of the disclosure.

With reference now to the drawings, and in particular to FIGS. 1 through 5 thereof, a new spatula cleaning assembly embodying the principles and concepts of an embodiment of the disclosure and generally designated by the reference numeral 10 will be described.

As best illustrated in FIGS. 1 through 5, the spatula cleaning assembly 10 generally comprises a scraper 12 that may be manipulated. The scraper 12 frictionally engages a spatula 14 such that the scraper 12 removes debris from the spatula 14. The spatula 14 may be a bbq spatula or the like. The debris may be grease or organic material that is cooked onto the spatula 14.

The scraper 12 comprises a plate 18 that has a peripheral edge 20 and a first surface 22. The peripheral edge 20 has a back side 23. The first surface 22 has a first well 24 extending inwardly therein. A handle 26 is coupled to and extends away from the back side 23. The handle 26 may be gripped.

The handle 26 has a distal end 28 with respect to the plate 18. An opening 30 extends through the handle 26. The opening 30 is positioned closer to the distal end 28 than the plate 18. The opening 30 may receive a hook or the like thereby facilitating the scraper 12 to be stored. A lobe 32 extends downwardly from the handle 26 thereby enhancing gripping the handle 26. The lobe is 32 positioned closer to the plate 18 than the distal end 28.

A first pad 40 is positioned within the first well 24. The first pad 40 frictionally engages the spatula 14. The first pad 40 is comprised of a resiliently coarse material. Thus, the first pad 40 scours the debris from the spatula 14.

A panel 42 is hingedly coupled to the scraper 12. The panel 42 is manipulated to compress the spatula 14 between the scraper 12 and the panel 42. The panel 42 has a primary surface 44 and a perimeter edge 46. The perimeter edge 46 has a rear side 48. The rear side 48 is hingedly coupled to the back side 23 of the plate 18. Moreover, the primary surface 44 faces the first surface 22. The primary surface 44 has a second well 50 extending inwardly therein.

A second pad 52 is provided. The second pad 52 is positioned within the second well 50. The second pad 52 frictionally engages the spatula 14. The second pad 52 is comprised of a fluid permeable material. Thus, the second pad 52 may rinse the spatula 14. The second pad 52 may be sponge or the like and the fluid may be water.

In use, the second pad 52 is soaked with the fluid. The spatula 14 is positioned between the panel 42 and the plate 18. The panel 42 is manipulated to compress the spatula 14 between the panel 42 and the plate 18. The spatula 14 is pulled through the scraper 12. Thus, each of the first pad 40 and the second pad 52 clean the spatula 14. The spatula 14 is pulled through the scraper 12 repeatedly until the spatula 14 is clean.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A spatula cleaning assembly being configured to clean a spatula, said assembly comprising:

a scraper being configured to be manipulated thereby facilitating said scraper to frictionally engage a spatula such that said scraper removes debris from the spatula, said scraper comprising:

a plate having a peripheral edge and a first surface, said peripheral edge having a back side, said first surface having a first well extending inwardly therein, and a handle being coupled to and extending away from said back side wherein said handle is configured to be gripped;

a first pad being positioned within said first well wherein said first pad is configured to frictionally engage the spatula, said first pad being comprised of a coarse material wherein said first pad is configured to scour debris from the spatula;

a panel being hingedly coupled to said scraper wherein said panel is configured to be manipulated thereby facilitating the spatula to be compressed between said scraper and said panel, said panel having a primary surface and a perimeter edge, said perimeter edge having a rear side, said rear side being hingedly coupled to said back side of said plate having said primary surface facing said first surface, said primary surface having a second well extending inwardly therein; and a second pad being positioned within said second well wherein said second pad is configured to frictionally engage the spatula, said second pad being comprised of a fluid permeable material wherein said second pad is configured to rinse the spatula, said first pad and said second pad being compressed together when said plate and said panel are positioned in abutment wherein said first pad and said second pad have abutting surfaces and said plate and said panel have abutting edges, said abutting surfaces of said first pad and said second pad being coplanar with said abutting edges of said plate and said panel.

* * * * *